US009988817B2

(12) United States Patent
Johnson

(10) Patent No.: US 9,988,817 B2
(45) Date of Patent: Jun. 5, 2018

(54) GATE VALVE DOWNSPOUT DIVERTER FOR RAINWATER COLLECTION

(71) Applicant: Loren Johnson, Friday Harbor, WA (US)

(72) Inventor: Loren Johnson, Friday Harbor, WA (US)

( * ) Notice: Subject to any disclaimer, the term of this patent is extended or adjusted under 35 U.S.C. 154(b) by 37 days.

(21) Appl. No.: 15/053,122

(22) Filed: Feb. 25, 2016

(65) Prior Publication Data

US 2017/0002570 A1 Jan. 5, 2017

Related U.S. Application Data

(63) Continuation-in-part of application No. 14/791,136, filed on Jul. 2, 2015, now abandoned.

(51) Int. Cl.
*E03B 3/02* (2006.01)
*E04D 13/08* (2006.01)
*E03B 3/03* (2006.01)

(52) U.S. Cl.
CPC ..... *E04D 13/08* (2013.01); *E03B 3/02* (2013.01); *E03B 3/03* (2013.01); *E04D 2013/082* (2013.01)

(58) Field of Classification Search
CPC ..... E03B 3/02; E03B 3/03
USPC ..... 137/356, 357, 872, 873, 874, 876; 52/16
See application file for complete search history.

(56) References Cited

U.S. PATENT DOCUMENTS

| | | | | |
|---|---|---|---|---|
| 1,865,926 | A * | 7/1932 | Laing | H02G 15/10 16/108 |
| 3,085,592 | A * | 4/1963 | Zajac | F16K 15/18 116/277 |
| 3,990,474 | A | 11/1976 | Harms | |
| 8,517,047 | B2 | 8/2013 | Soo Hean Teo | |
| 8,739,817 | B2 | 6/2014 | Griffin | |
| 2011/0226350 | A1* | 9/2011 | Russell | E04D 13/08 137/357 |
| 2011/0315610 | A1* | 12/2011 | Graf | E03B 3/03 210/88 |

OTHER PUBLICATIONS

DE 4217460; Tschunko; Dec. 2, 1993; Original and Translation.*

* cited by examiner

*Primary Examiner* — Kevin Murphy
*Assistant Examiner* — Paul J Gray
(74) *Attorney, Agent, or Firm* — Clark A. Puntigam; Jensen & Puntigam, P.S.

(57) ABSTRACT

A downspout diverter for rainwater collection that is installed through a hole in the wall of a downspout and functions as a gate valve by redirecting the flow of water from a pan-like Interior gate through a fitted bushing and exterior hose spout. The gate can be turned from its horizontal capture position to its vertical non-capture position by rotating the bushing. It is easy to install and remove without disconnecting the downspout, and its small size and accessory plug effect a finished appearance to the downspout.

3 Claims, 6 Drawing Sheets

FIG. 2
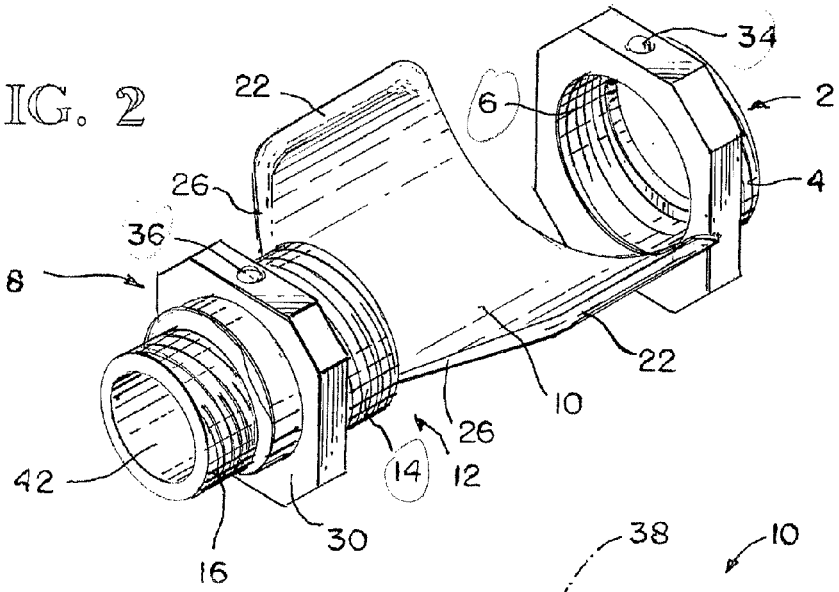
FIG. 4
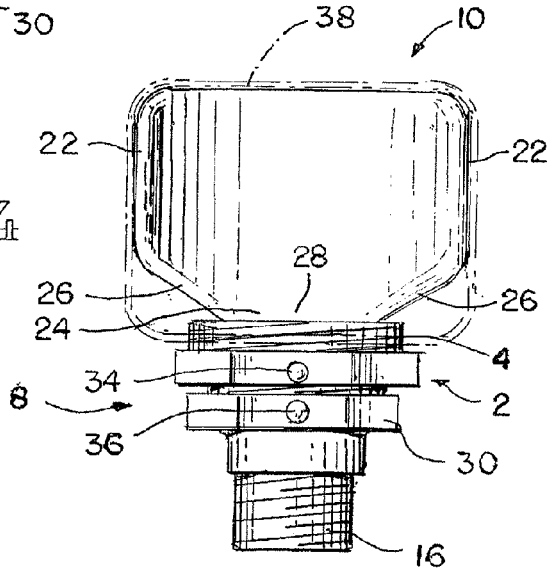
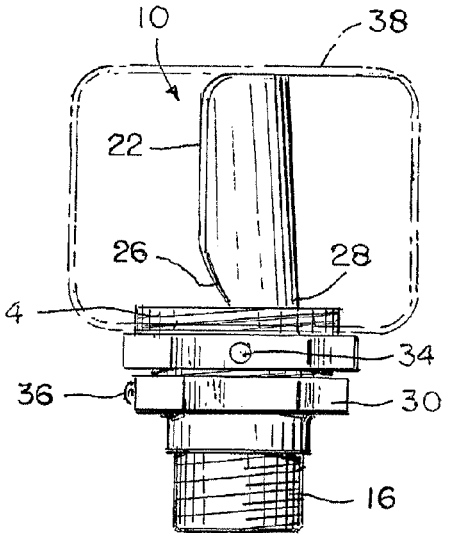
FIG. 5

FIG. 13
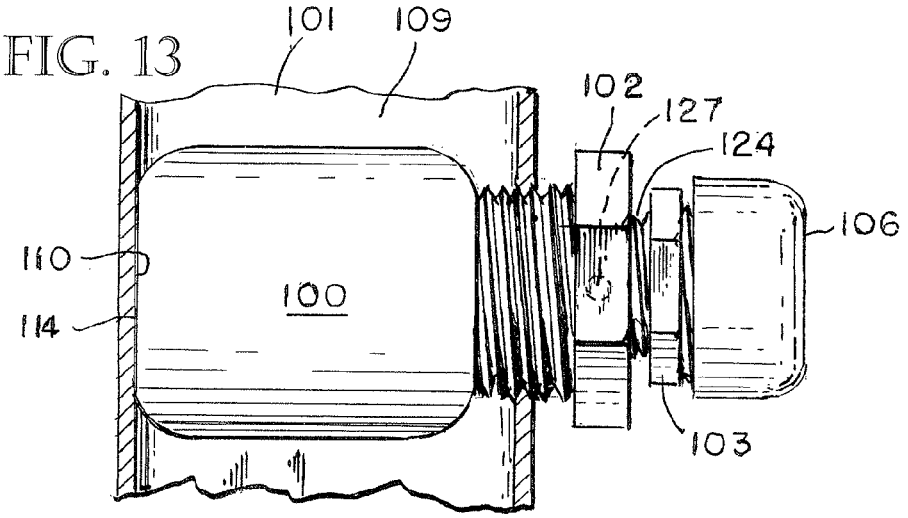
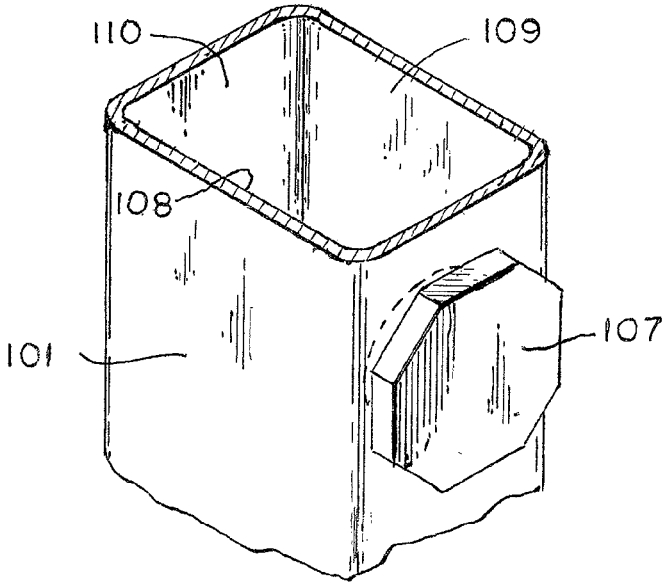
FIG. 14

GATE VALVE DOWNSPOUT DIVERTER FOR RAINWATER COLLECTION

PREVIOUS APPLICATION

This application is a continuation-in-part of application Ser. No. 14/791,136, filed on Jul. 2, 2015, the priority of which is claimed.

TECHNICAL FIELD

The present invention concerns an apparatus that can be installed in a gutter downspout to divert rainwater for collection and storage using a gate valve mechanism.

BACKGROUND OF THE INVENTION

Climate change and drought conditions in world temperate zones are likely to lead to an increased demand for water catchment and storage. Most jurisdictions in the United States allow residential water catchment for the harvest of non-potable water. For example, California's "Rainwater Capture Act of 2012" [ 2012 Cal. Stats. ch. 537, Sec. 2.] exempts the capture and use of rainwater from rooftops from the State Water Resources Control Board's (SWRCB) permitting authority over appropriations of water. According to the Board, "This development affords residential users and private and public entities with a new source of onsite water supply, which should reduce reliance on potable water for landscaping needs and provide a recharge benefit to underlying groundwater aquifers". Rain barrels and onsite water storage systems have become popular, and the gutter and downspout systems of dwellings and small buildings can be retrofitted to divert rainwater into storage tanks.

Currently available downspout diverters are difficult to install, and usually require disconnecting or defacing the downspout.

Griffin, U.S. Pat. No. 8,739,817 B2, discloses a diverter and lid assembly for use with a rain barrel system. It has a central scoop installed in the downspout, however it is not adjustable and requires a 2⅛" hole for installation. The resulting port can be covered with a large cap that must be attached with screws to the downspout.

Soo Hean Teo, U.S. Pat. No. 8,517,047 B2, describes a gate that swings in and out of the downspout through an exterior housing.

Harms, U.S. Pat. No. 3,990,474 A, describes a gate formed by the wall of the downspout that has no hose attachment.

Others disclose a variety of devices with housings, pipes and attachments to divert water, but none describe an internal rotating catchment gate as disclosed in this application.

SUMMARY OF THE INVENTION

The assembled downspout diverter unit comprises a catchment gate, bushing and hose spout, that is installed through a hole in the downspout, wherein the bushing is seated in said hole, and the unit can be turned with the gate positioned horizontally to capture and divert the water through the bore of the bushing and spout, or can be turned vertically to reopen flow in the downspout.

BRIEF DESCRIPTION OF THE DRAWINGS

FIG. 2 Perspective (isometric) of exploded parts.

FIG. 4 Top plan view of the installed device with Diverter Unit in the capture position.

FIG. 5 Top plan view of the installed device with Diverter Unit in the non-capture position.

FIG. 13 Front elevation view of view in the non-capture position.

FIG. 14 Perspective (isometric) view of threaded plug in downspout

BEST MODE FOR CARRYING OUT THE INVENTION

Figure 1:
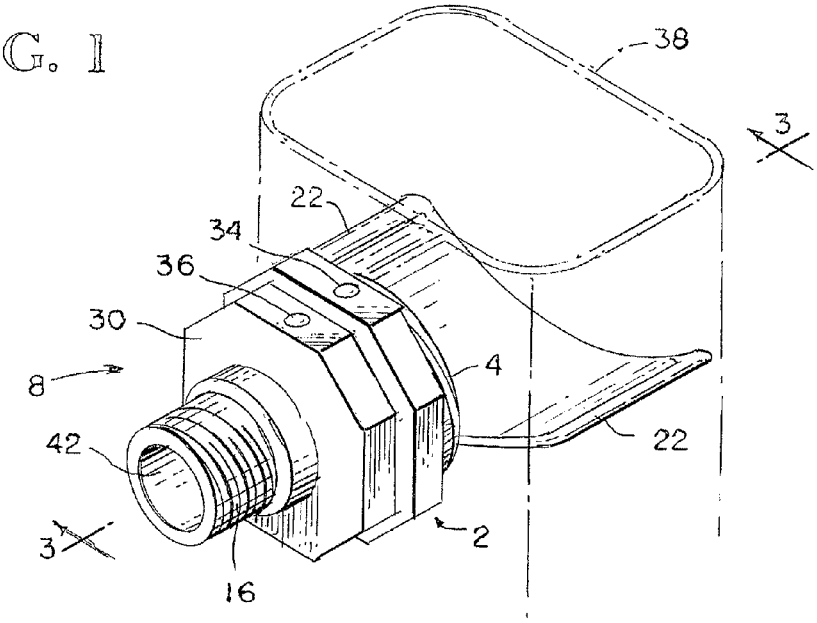
FIG. 1 Perspective of the assembled invention.
Figure 3:
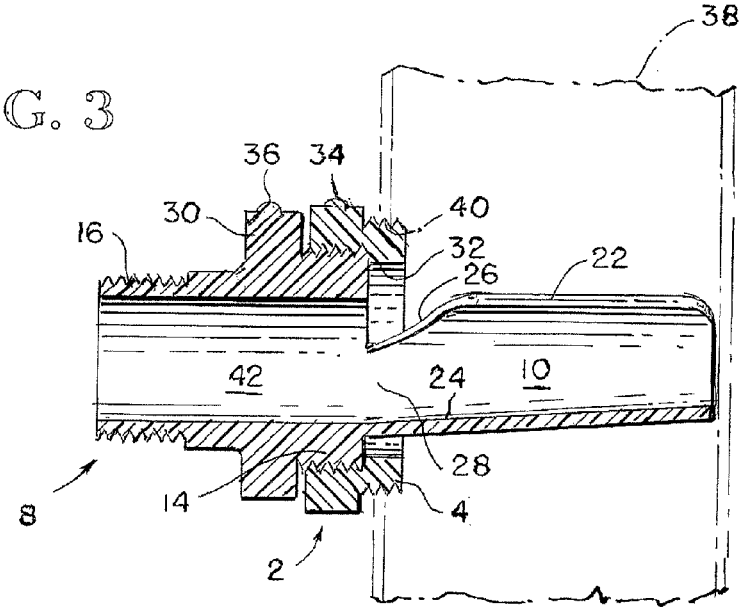
FIG. 3 Vertical cross section taken on 3 3 of FIG. 1 with everything assembled.
Figure 6:
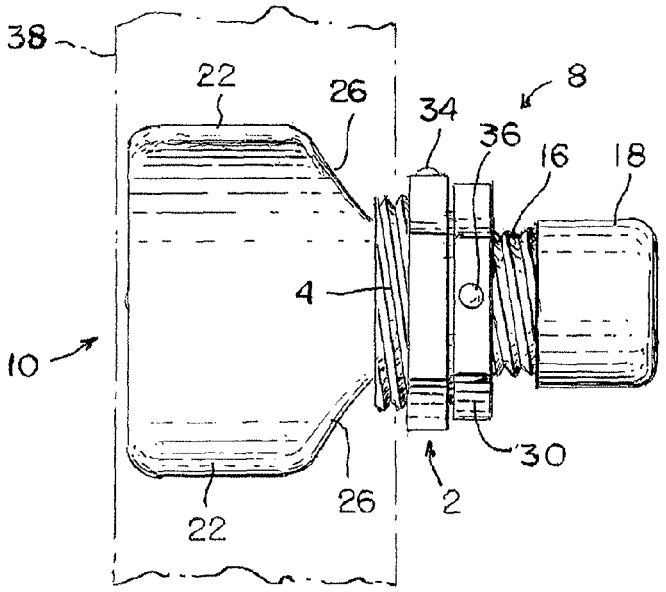
FIG. 6 Left side view of the installed device with Diverter Unit and Threaded cap, in the noncapture position.
Figure 7:
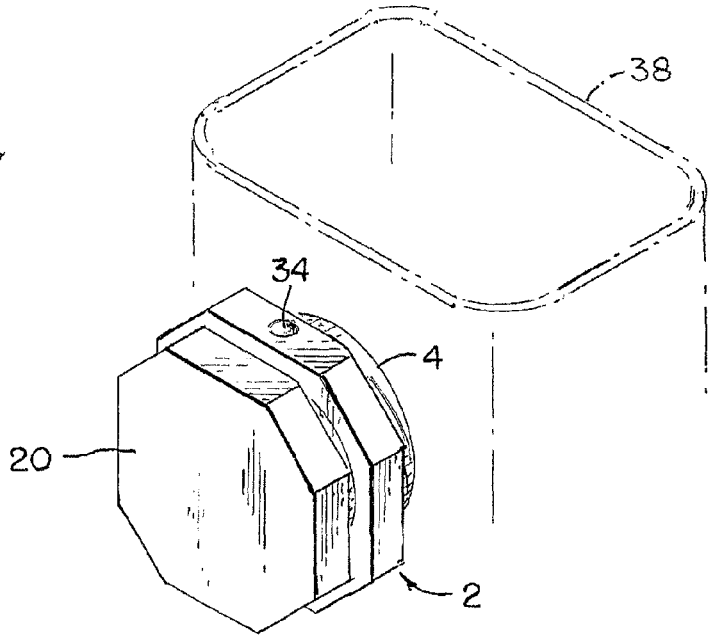
FIG. 7 Perspective (isometric) view of Wall Bushing and Threaded Plug.

A preferred form of the device has four parts; a Wall Bushing 2 (FIG. 2), a Diverter Unit 8 (FIG. 2), a Threaded Cap 18 (FIG. 6), and a Threaded Plug 20 (FIG. 7). The Wall Bushing 2 is a plastic reduction bushing with a threaded male nipple 4 and threaded female port 6. It is installed by cutting a round hole in the face of the downspout and threading the nipple 4 clockwise into the hole. Once installed, it forms a permanent port for installation and removal of the Diverter Unit 8, and provides a threaded bearing for its seating and rotation. The Diverter Unit 8 is a single part formed of plastic. It consists of a pan-like catchment gate 10 that captures water within the downspout 38, a cylindrical body 12 with a threaded male nipple 14 that can be screwed into the female port 6 of the Wall Bushing 2, and a hose attachment spout 16 for water egress. Once installed, the Diverter Unit can be manually rotated to its marked capture position (FIG. 4) and non-capture position (FIG. 5) by grasping and rotating the body 12 clockwise or counterclockwise. The Threaded Cap 18 is used to seal the spout 16 when a hose is not attached (FIG. 6), and the Threaded Plug 20 is used to seal the port 6 when the unit 8 is removed, leaving a trim appearance to the downspout (FIG. 7). The device can be manufactured as a builtin component of the downspout, and unlike other diverters, can be retrofitted in place without detaching the downspout from the building.

The catchment gate portion of the Diverter Unit 8 has a broad paddle-shaped pan 10 with tilted flanges 22 along its distal rim, and is shaped to capture most of the water flowing in the downspout 38. It has a thickened stem 24 that provides axial rigidity, and a tapered base 26 and thin expanse 28 that provides radial flexibility. Its sides 22 are coiled manually for insertion through the port 6, and because of the tapered base, they coil automatically when withdrawn through the port. When installed in its horizontal capture position, the gate 10 channels water into the central bore 42 of the body and spout. When turned 90 degrees counterclockwise to its vertical position, it no longer captures water, and flow in the downspout 38 is restored. Its shape is non-occlusive and permits overflow during a heavy rain. And, normal downflow can easily be restored by rotating or removing the unit 8.

Residential downspouts are commonly made from steel, aluminum or vinyl, formed in rectangular tubes, 2"×3" in cross section; or, in cylindrical tubes 3" in diameter. Larger models are made for larger roofs and gutter systems. Older models of rectangular downspouts have flat walls. Most current models are corrugated and semi-rounded. The face wall of a common 3 inch wide corrugated rectangular downspout maximally accommodates a 2⅛" hole, cut perpendicularly through its side wall. Likewise, the wall of a 3" cylindrical downspout can be cut to accommodate insertion of a threaded wall bushing, but the depth for full insertion is proportionate to the diameter of the bushing; hence a smaller diameter bushing results in a lesser intrusion into the downspout.

This device mounts through a 1½" hole and fits in standard rectangular and cylindrical downspouts, as described. The spout is sized for the attachment of a ¾" garden hose, however larger devices can be formed for larger downspouts and fitted for larger hoses and systems as desired.

For installation in a standard 2"×3" flat or corrugated downspout, a round 1½" hole is cut in the face of the downspout using a precision hole saw. The Wall Bushing 2 is threaded clockwise into the hole, using a wrench on the hex surround if necessary, until it firmly seats with its marker 34 pointed upward. The sides 22 of the gate 10 portion of the Diverter Unit 8 are manually rolled into a rounded coil and the gate 10 is passed into the lumen of the downspout through the Wall Bushing 6. The body of the Diverter Unit 8 is threaded clockwise into the Wall Bushing 2 until it comes to a firm stop against the stop wall 32, with top markers 34 and 36 aligned. Once installed, the gate 10 rebounds into its pan-like shape and the device is ready to divert water into a hose and storage tank.

For removal, the diverter unit is unthreaded counterclockwise from the Wall Bushing 2 and firmly pulled from the downspout. The tapered edges 26 of the gate 10 force the gate to coil as it is withdrawn. The Threaded Plug 20 is installed in the port 6, and the Diverter Unit 8 can be saved for repeated use.

The unique advantages of the Gate Valve Downspout Diverter as described are: its ease of installation without disconnecting and sectioning the downspout; its ease of opening and closing to adjust water capture; its ease of removal for cleaning and seasonal use; and, the small size of its port and fixtures that effect a finished appearance to the downspout.

Figure 8:
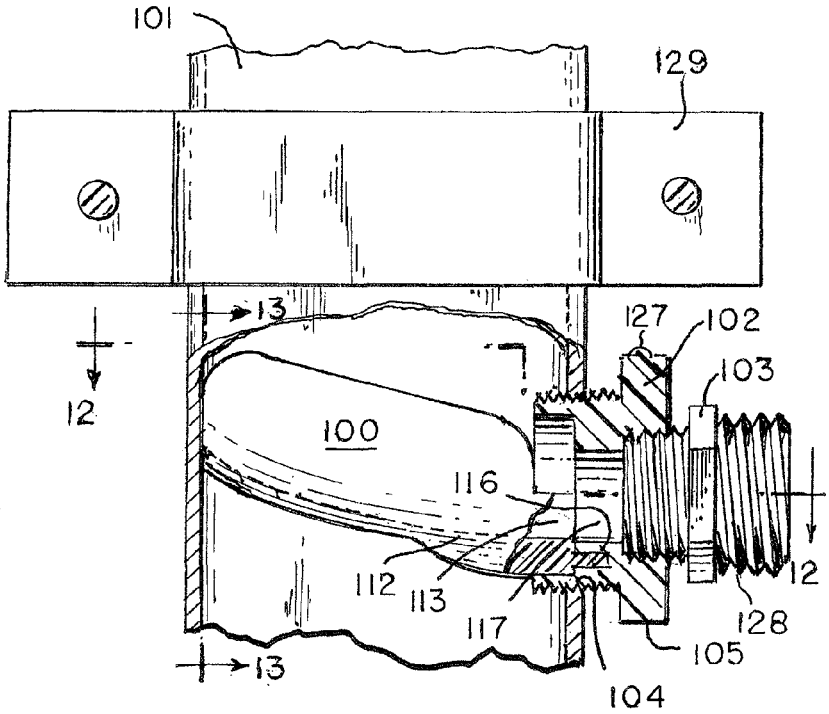
FIG. 8 Side elevation cutaway view of the assembled invention.
Figure 10:
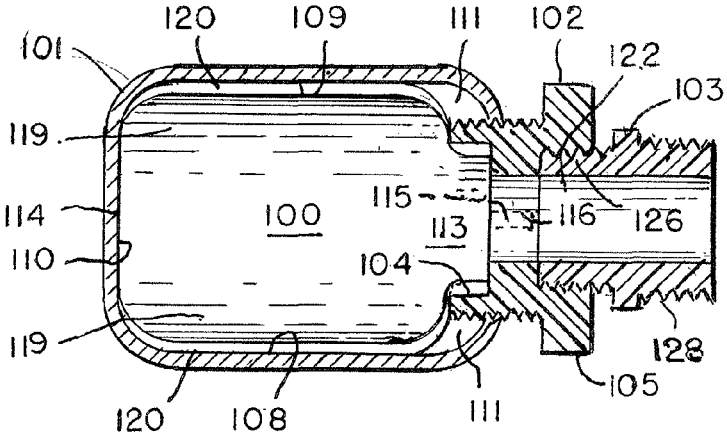
FIG. 10 Top plan view on 12 12 of FIG. 10 in the capture position.
Figure 9:
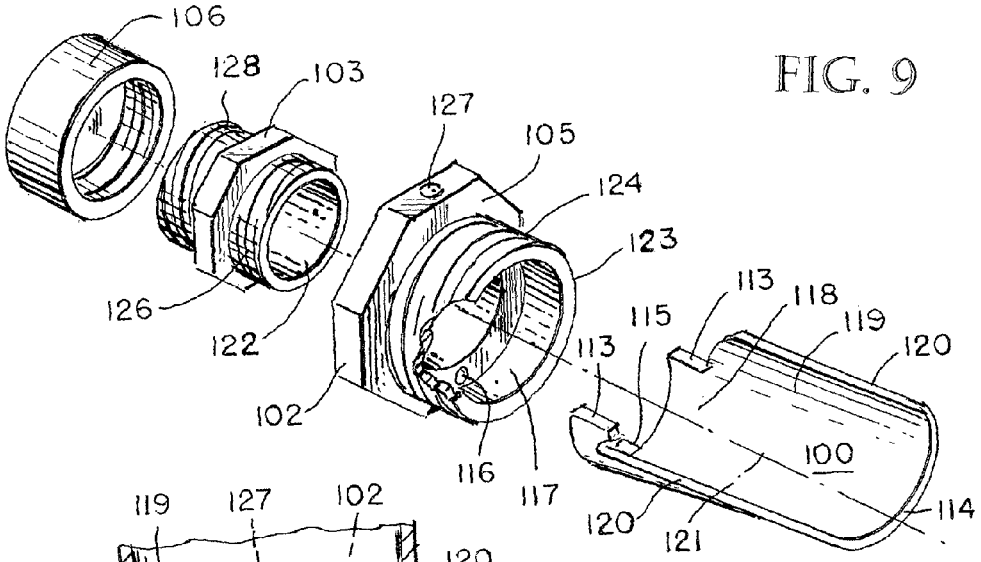
FIG. 9 Perspective (isometric) of exploded parts.
Figure 11:
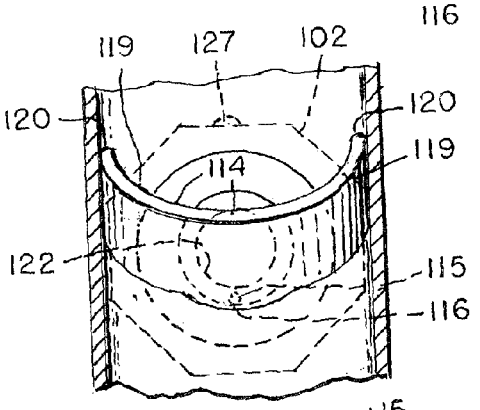
FIG. 11 Side elevation view on 13 13 of FIG. 10 in the capture position.

Another preferred form of the continuation device (FIG. 8) consists of a three parts (FIG. 9), a scoop shaped catchment gate 100 that captures water within the downspout 101 and diverts it through an attached 1¼×¾" reducing bushing 102 and dual male nipple hose spout 103. It is installed by cutting a round hole 104 in the side of the downspout 101, coiling and inserting the gate, and threading the bushing into the hole. It can be fabricated as a single embodiment or assembled from its fitted parts (FIG. 9) prior to installation. Once installed, the gate can be manually rotated to its marked capture and non-capture positions (FIGS. 11 & 12) by grasping the exterior hex head of the bushing 105 and rotating it clockwise or counterclockwise. A threaded cap 106 can be used to seal the spout when the hose is removed, and a threaded plug 107 can be used to seal the hole when the diverter is removed, effecting a trim appearance to the downspout (FIG. 14). The preferred form of the device is for retrofit use in existing downspouts, however it could also be incorporated as a built-in component of the manufactured downspouts. And, unlike most other diverters, the retrofit device can be installed in place, without detaching the downspout from the building.

The catchment gate 100 is a scoop shaped tilted pan that spans a cross sectional portion of the downspout 101 and touches and captures water from the interior surface of the front wall 108, back wall 109, and distal lateral wall 110 of the downspout, when positioned upright and horizontally. Gaps 111 on each side of the bushing nipple permit overflow of excess water during a heavy rain. The gate has a thickened stem 112 that provides axial rigidity along its central axis from its base 113 to its coved and tapered distal edge 114. In its modular form, the gate and bushing are assembled by inserting the peg 115 located at the base of the gate 113 into a small hole 116 located in the lower reach of the bushing fossa 117, and tightly abutting said base into said fossa with glue fixation. The gate 100 is tilted downward from its elevated distal end 114 into its deep proximal trough 118, which buttresses the outflow. It has flexible lateral expanses 119, and thin edges 120 that conform within the walls of the downspout and provide radial flexibility for insertion and removal from the downspout. It can be coiled manually along its central axis 121 for insertion through the hole in the downspout, and it coils automatically when withdrawn through the hole. When placed in its upright horizontal position (FIG. 11), the gate captures and channels the water through the central bore 122 of the bushing 102 and spout 103. When turned 90 degrees counterclockwise to its vertical position (FIG. 12) it no longer captures water, and normal flow in the downspout is restored.

Figure 12:
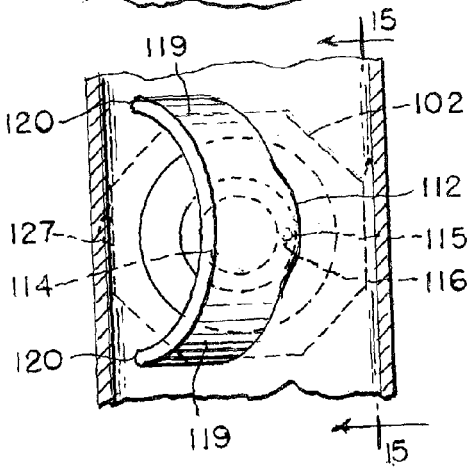
FIG. 12 Side elevation view on 13 13 in the non-capture position.

The bushing has a hex surround configuration 105 so that it can be installed with a wrench. Its threaded male nipple 123 is tapered more widely at its base 124, and sized to fill the entry hole 104 when tightly installed. Its exterior female port 125 is sized to accept the threaded distal male nipple 126 of the hose spout 103. It has a top marker 127 that confirms that the gate is in its upright position and horizontal and ready to capture water when turned upward. To switch to the non-capture position, the device is simply rotated 90 degrees counterclockwise with the marker 127 pointed leftward to indicate that the gate 100 is in the vertical or open position (FIG. 12).

Gate valve diverters, as first described here, can be fabricated in a variety of sizes and shapes to fit different types of downspouts. This embodiment has a 1¼"×¾" reducer bushing 102 that is designed to thread into a 1⅝" hole 104 placed in either lateral wall of a 2×3" corrugated downspout 101. The proximal male nipple 128 of the hose spout 103 accepts the threaded female fitting of a standard ¾" garden hose.

For installation of the assembled device, a preferred site is chosen on either of the lateral walls of the downspout, well above the filling level of a preselected rain barrel or water storage device. A reinforcing downspout bracket 129 is installed at least two inches above or below the entry point. The hole 104 is cut into the center corrugation of the downspout wall, using in one embodiment a 1⅝" precision hole saw. The interior edges of the hole may need to be deburred, and teflon tape may need to be applied to the threads at the base of the bushing 124 to effect a tight fit. The device is then inserted by manually rolling the gate 100 into a rounded coil and passing it through the hole 104 into the lumen of the downspout. The male nipple 123 of the bushing is inserted and threaded clockwise through the hole until it seats near its base 124, with its marker 127 pointed upward.

A wrench can be used to turn the hex surround 105 if necessary. Once installed, the gate 100 rebounds into its pan-like shape. A garden hose can then be attached convey water to a storage tank.

For removal, the bushing 102 is unthreaded counterclockwise and the gate 100 is extracted by turning it into its horizontal position and lifting and pulling the bushing upward and outward, so that the gate is forced into a coil as it is being withdrawn through the hole. The gutters and downspouts can then be cleaned and flushed, and the diverter can be saved for repeated use. Finally, the threaded plug 107 is installed in the hole to effect a finished appearance to the downspout.

The advantages of the gate valve downspout diverter as herein described are its ease of installation without disconnecting and sectioning the downspout, its adjustable positioning for water capture, its ease of removal for cleaning and seasonal use, and the small size of its port and fixtures that effect a finished appearance to the downspout.

What is claimed is:

1. A downspout diverter unit with a catchment gate that can be positioned horizontally to capture and redirect water through an alternative port in the downspout, or turned vertically to reopen a lumen of the downspout, wherein the diverter unit has a hose attachment spout at the proximal end thereof, wherein the catchment gate channels water into an attached cylindrical body that can be used to rotate the gate into its capture and non-capture positions, wherein the catchment gate, cylindrical body and hose attachment spout are formed as a single diverter unit that captures water in its gate and channels it through the central bore of the cylindrical body and spout, wherein the catchment gate further comprises a flexible plastic material formed into a broad pan to capture water when it is turned to an upright position, wherein a reducer bushing is installed in a round hole in a face of the downspout, wherein the diverter unit is installed by rolling the catchment gate into a round coil and inserting it through a port in the reducer bushing into the lumen of the downspout and by screwing male threads of the cylindrical body portion into female threads of the reducer bushing, wherein both the reducer bushing and the body portion of the diverter unit have hex surrounds with top markers to indicate their relative positions and show whether the gate is opened or closed.

2. The diverter in claim 1, in which the reducer bushing is maintained as a permanent port for seating and removal of the diverter.

3. The diverter in claim 1, in which the gate portion has a thin expanse with a tapered stem connected to its body to allow it to be rolled into a coil for insertion and removal from the downspout.

* * * * *